US006601301B2

(12) United States Patent
Lacchetti et al.

(10) Patent No.: US 6,601,301 B2
(45) Date of Patent: Aug. 5, 2003

(54) JEWELRY FORMED BY SECTIONS OF MULTIPLY COLORED ELEMENTS AND PROCESS FOR MAKING THE SAME

(76) Inventors: GianPaolo Lacchetti, Viale dell'Industria, 37 Trissino, Vicenza (IT); GianFranco Lacchetti, Viale dell'Industria, 35, Trissino, Vicenza (IT)

( * ) Notice: Subject to any disclaimer, the term of this patent is extended or adjusted under 35 U.S.C. 154(b) by 0 days.

(21) Appl. No.: 09/950,206

(22) Filed: Sep. 10, 2001

(65) Prior Publication Data

US 2002/0029476 A1 Mar. 14, 2002

(51) Int. Cl.[7] ..... A44C 27/00

(52) U.S. Cl. ..... 29/896.411; 29/896.41; 29/896.43; 63/3; 72/368

(58) Field of Search ..... 29/896.43, 896.4, 29/896.41, 896.411; 138/104, 177; 428/614, 670, 672, 673; 72/52, 368

(56) References Cited

U.S. PATENT DOCUMENTS 450,412 A * 4/1891 Knight ..... 29/896.43
921,722 A * 5/1909 Meyer ..... 29/896.43
3,063,137 A * 11/1962 Leach ..... 29/896.43
3,755,881 A * 9/1973 White et al.
3,955,934 A * 5/1976 Tizzi ..... 29/896.43
6,089,949 A * 7/2000 Resper et al.
6,092,358 A * 7/2000 Grosz ..... 29/896.41

* cited by examiner

*Primary Examiner*—P. W. Echols
(74) *Attorney, Agent, or Firm*—Notaro & Michalos P.C.

(57) ABSTRACT

Process for making jewels such as necklaces, bracelets or the like with different colors on at least two of their faces in sight so that a user can choose to put on the necklace or jewel so as to show one face or the other of the jewel according to the wished color, for instance the user can show a white gold face or a yellow gold face.

In general, the process in question consists of a first phase in which noble metal bands (3, 4) showing different colors are put near each other.

Then, the bands (3, 4) are coupled by welding (6) and are subjected to a second working phase in which they are bent and welded longitudinally so as to obtain a pipe (19) showing a multiple color.

From this pipe (19) it is possible to obtain hollow links to be then mounted and fixed on a flexible core.

5 Claims, 2 Drawing Sheets

JEWELRY FORMED BY SECTIONS OF MULTIPLY COLORED ELEMENTS AND PROCESS FOR MAKING THE SAME

FIELD AND BACKGROUND OF THE INVENTION

The present invention provides a process and related means for making double-faced jewelry consisting of differently colored elements on both opposite sides.

The process permits making jewelry such as necklaces, bracelets or the like with different colors on at least two of their visible faces. A user can choose to put on the necklace or jewelry so as to show one face or the other of the jewelry according to the desired color. For instance, the user can show a white gold face or a yellow gold face of the jewelry.

Thus, the realization of the process according to the present invention provides a very advantageous result, although it is not conceptually new in the jeweler's art: it is the result of using double-faced jewelry which is made completely of precious solid metal and not simply covered as in prior known solutions.

As is known, in the jeweler's art, several processes are used to produce necklaces, bracelets and jewelry of any kind.

One type of such jewelry has recently interested purchasers a great deal and is now in great demand. It is the hollow necklace or bracelet. That is, jewelry in which a chain is formed by a succession of links which are essentially cylindrical and are in general flattened to have an elliptic section. These links are put near each other on a flexible core.

This particular type of chain is fit for several variants and appliances such as the insert composition and setting, the application and realization of decorations and ornaments, the gold covering of both opposite sides with bands having different color tonalities, for instance, white and yellow gold bands, so as to obtain double-faced, hollow necklaces.

In this way, an original chromatic effect is obtained and the purchaser can choose to put on the necklace in order to show one colored face or the other, the visual effect being thus different each time.

However, the use of that kind of jewelry has given rise to some drawbacks. The main drawback relates to the kind of working to be effected.

Generally, this kind of working consists of rolling processes or covering processes in which a base support is covered with gold foils or foils made of other metals having different colors, and usually two colors.

This kind of working involves practical drawbacks relating to a certain difficulty in the production and above all, a rapid deterioration of the jewelry.

In fact, the jewelry can be subjected to scratches, signs or the like that provoke a partial removal of the covering with all the evident consequences.

SUMMARY OF THE INVENTION

The aim of the present invention is to conceive a new working process for producing hollow double-faced necklaces, not by covering a base material, but by coupling precious metal parts having different colors or precious metal parts having different compositions.

After suitable working and bending processes, such parts form a pipe from which it is possible to obtain single metal links displaying two or more colors. The single metal links having two or more colors are mounted on a flexible core and form either chains or necklaces or bracelets, all of them being double faced. That is, they show different colors on each of their sides.

The above-mentioned objects and advantages are achieved according to the invention through a process and related means for producing double-faced jewelry. The process is characterized by a first phase in which precious metal bands having different colors are placed side-by-side and are coupled by welding. In a second phase, the resulting double precious metal band having two colors is subjected to a bending process and longitudinal welding to obtain a pipe showing different colors, from which pipe links are obtained that can be mounted and fixed on a flexible core.

Further features and details of the invention can be better understood from the following specification given as a non-exclusive example with reference to the accompanying drawings.

DESCRIPTION OF THE PREFERRED EMBODIMENTS

Figure 1:
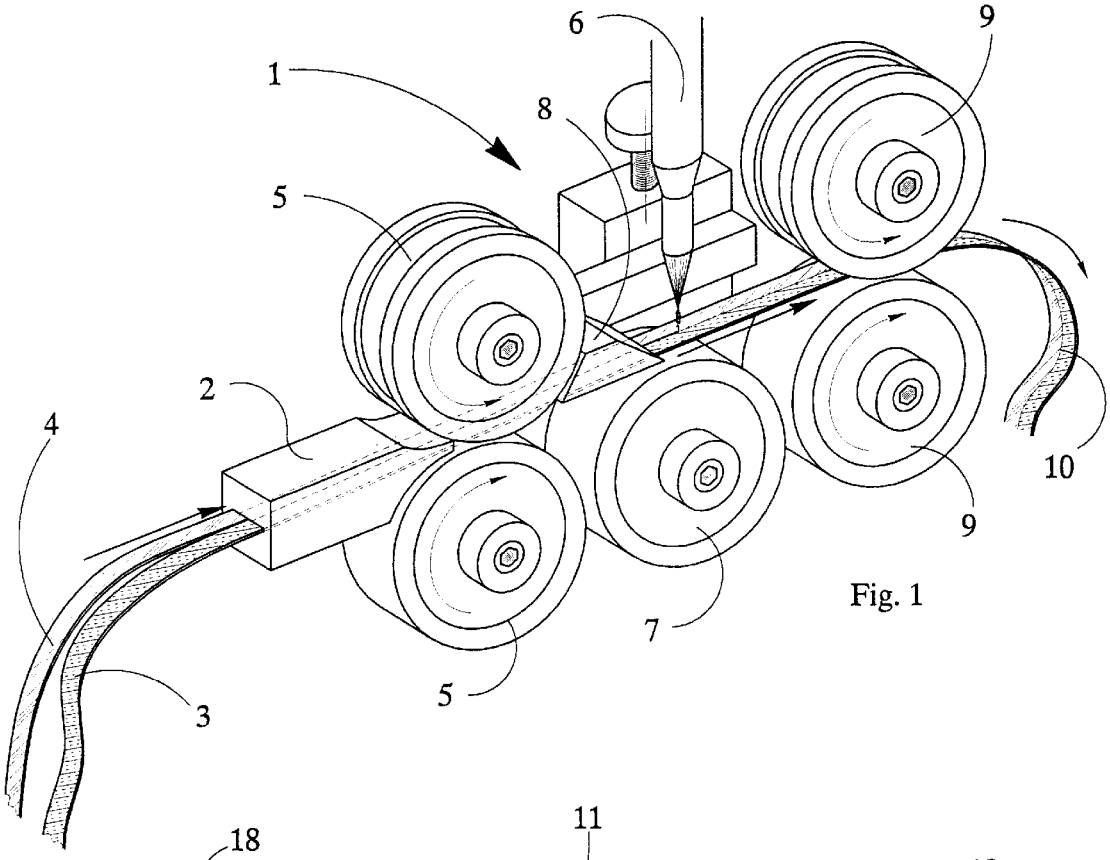
FIG. 1 shows a schematic perspective view of an apparatus for performing a first working according to the invention.

Referring now to the drawings, in FIG. 1, a machine 1 for effecting a first phase of the process according to the invention in which two or more bands of different colors are put near to each other.

As shown, two metal bands 3, 4 are placed near to each other and arranged side-by-side. It should be understood that additional metal bands can be used, depending on the desired visual effect to be achieved.

The machine 1 receives two metal bands 3, 4 placed side-by-side and having different colors. For example one band 3 may be a white gold band, while the other band 4 is a yellow gold band.

Both metal bands 3, 4 are inserted in the front side of a shoe 2.

Then, both bands pass through drawing rollers 5, following which, they are subjected to a welding process in which their connection line is welded using a welding element, such as torch 6.

A good weld can be obtained by having the pair of bands 3, 4 pass the torch 6 on a supporting roller 7. The supporting roller 7 can be adjustable relative to an upper fixed countershoe 8.

Then, the welded bands 3, 4 pass through extraction rollers 9, which pull out the welded bands 3, 4, which now form a single band 10 having two colors.

The single, two-color band 10 can be processed to obtain a hollow, two-color pipe 19. The hollow, two-color pipe 19 is produced using a second machine 11 shown in FIG. 2 or another suitable machine.

Figure 2:
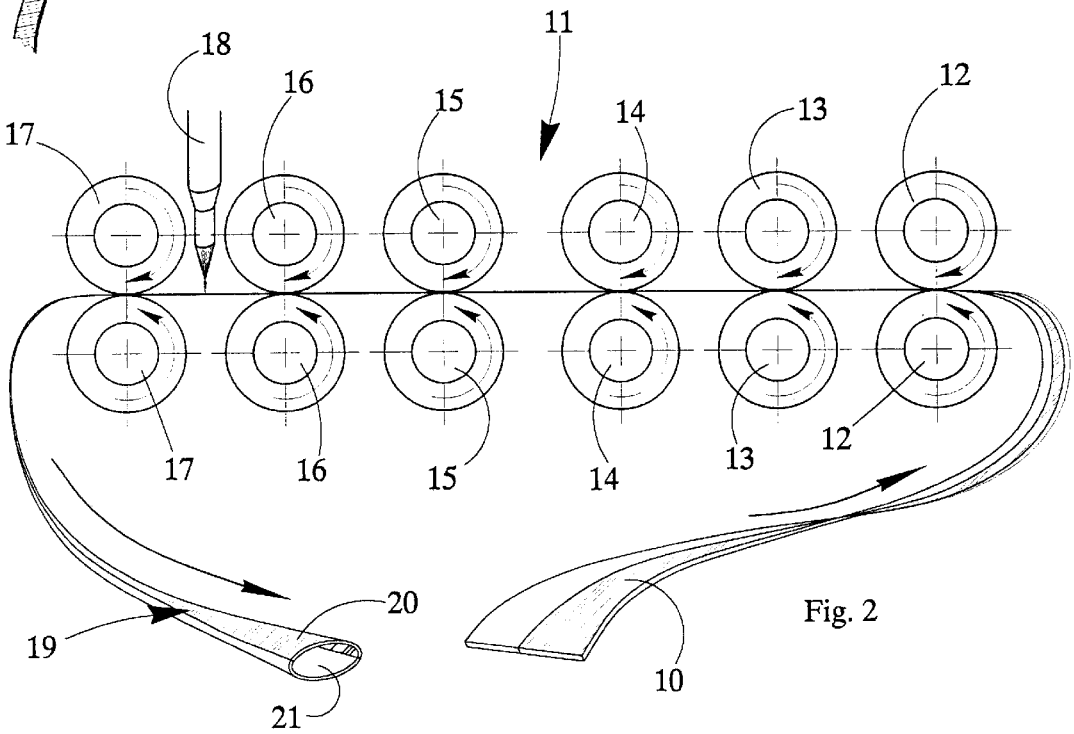
FIG. 2 shows a schematic perspective view of an apparatus for performing a second working according to the invention.

As shown in FIG. 2, the two-color band 10 passes sequentially through aligned pairs of rollers 12–17 which together effect a progressive shaping of the band 10 into pipe 19. The rollers 12–17 each have a suitably shaped profile which allow the two-color band 10 to be bend and welded along the free edges. The band 10 is shaped so that the free edges are placed adjacent each other and welded using a welding torch 18.

The resulting product consists of two-color pipe 19 having a longitudinal double chromatic effect formed by pipe parts 20, 21.

Figure 3:
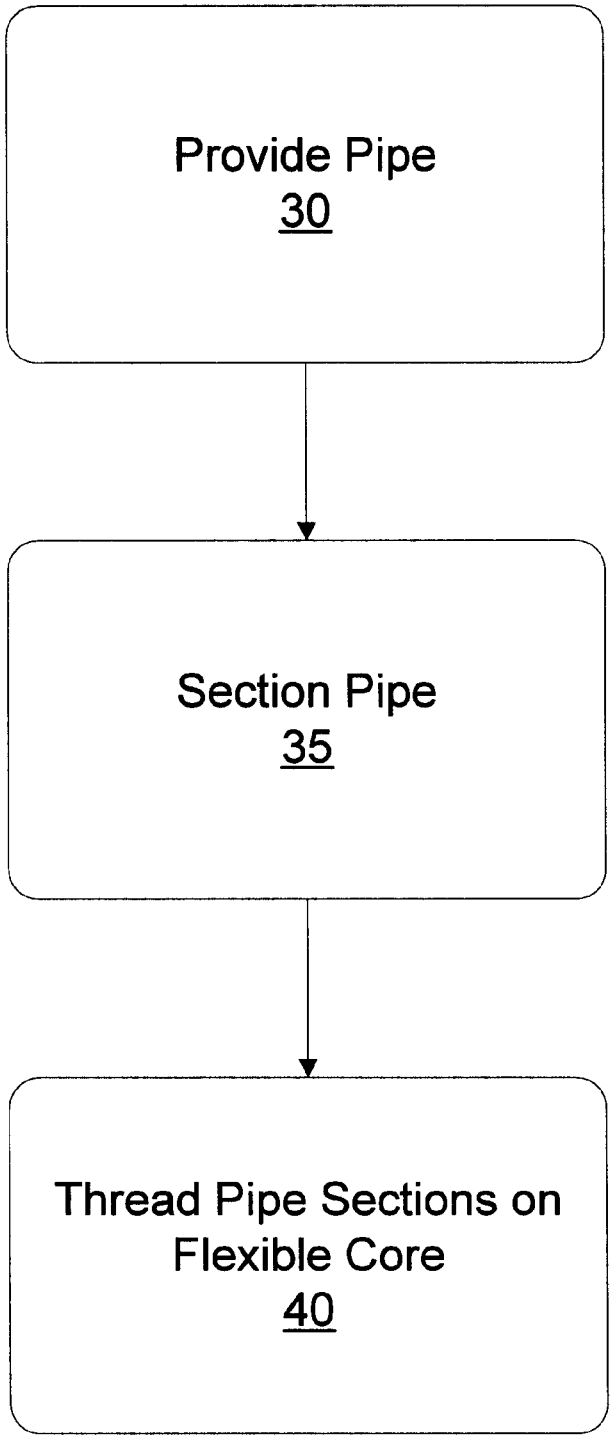
FIG. 3 shows a flow chart of the steps for making double-faced jewelry according to the invention.

Referring now to FIG. 3, a piece of jewelry can be produced from the two-color pipe 19 by the following steps. First, a two-color pipe 19 formed using the processes above is provided 30. Then, the two-color pipe 19 is sectioned 35 into several metal links each of which can display two or more colors. The links are then mounted 40 onto a flexible core to form a piece of jewelry. The links and flexible core can be used to form double-faced chains, necklaces or bracelets having sides with different colors.

The number of the metal bands to be placed side-by-side can be any number, but as described, the double-faced effect can be obtained using just two bands 3, 4.

One with technical skill in this field can provide other machines to perform the same process, for example, a machine with a single working line, and such solutions are considered to be included within the scope of the invention as set forth in the following claims.

What is claimed is:

1. A process for making a two-sided necklace or bracelet, comprising providing a flexible core, and threading a plurality of pipe sections onto the flexible core, each pipe section having two different colors, the pipe sections being segments of a pipe formed in two phases, the first phase comprising:

providing at least two differently colored precious metal bands;

arranging the at least two precious metal bands in a side-by-side orientation;

coupling adjacent sides of the at least two precious metal bands by welding to form a single multi-color band having at least two different colors; and the second phase comprising:

bending the multi-color band to place free edges of the multi-color band adjacent each other; and longitudinally welding the adjacent free edges together to form a multi-color pipe, whereby the multi-color pipe displays one of the at least two different colors on each of at least two sides all along a length of the multi-color pipe.

2. The process of claim 1, wherein the first phase further comprises feeding each of the at least two differently colored bands into a first machine, the first machine arranging the bands and having a welding torch for coupling the at least two differently colored bands.

3. The process of claim 2, wherein the first phase further comprises pulling the single multi-color band from the first machine using extraction rollers.

4. The process of claim 1, wherein bending the multi-color band comprises passing the multi-color band through a plurality of pairs of rollers having shaped profiles and arranged to progressively bend the multi-color band.

5. The process of claim 1, further comprising orienting each of the pipe sections to display one color of the pipe section on the flexible core.

* * * * *